US006867736B2

(12) United States Patent
Faraone et al.

(10) Patent No.: US 6,867,736 B2
(45) Date of Patent: Mar. 15, 2005

(54) MULTI-BAND ANTENNAS

(75) Inventors: Antonio Faraone, Plantation, FL (US); Robert E. Stengel, Pompano Beach, FL (US); Carlo Di Nallo, Sunrise, FL (US)

(73) Assignee: Motorola, Inc., Schaumburg, IL (US)

( * ) Notice: Subject to any disclaimer, the term of this patent is extended or adjusted under 35 U.S.C. 154(b) by 272 days.

(21) Appl. No.: 10/291,306

(22) Filed: Nov. 8, 2002

(65) Prior Publication Data

US 2004/0090373 A1 May 13, 2004

(51) Int. Cl.[7] ..... H01Q 1/38

(52) U.S. Cl. ..... 343/700 MS; 343/795; 343/846

(58) Field of Search ..... 343/700 MS, 702, 343/795, 846, 848, 895

(56) References Cited

U.S. PATENT DOCUMENTS 6,111,545 A * 8/2000 Saari ..... 343/702
6,184,836 B1 * 2/2001 Ali ..... 343/702
6,295,029 B1 * 9/2001 Chen et al. ..... 343/700 MS
6,329,962 B2 * 12/2001 Ying ..... 343/895
6,535,172 B2 * 3/2003 Hirabayashi ..... 343/725
6,707,427 B2 * 3/2004 Konishi et al. ..... 343/700 MS
6,734,826 B1 * 5/2004 Dai et al. ..... 343/700 MS
6,774,850 B2 * 8/2004 Chen ..... 343/700 MS
6,774,853 B2 * 8/2004 Wong et al. ..... 343/700 MS
6,781,546 B2 * 8/2004 Wang et al. ..... 343/700 MS
6,801,169 B1 * 10/2004 Chang et al. ..... 343/700 MS
6,801,170 B2 * 10/2004 Forrester et al. ..... 343/702

OTHER PUBLICATIONS

King, R.W.P. et al., Antennas and Waves: A Modern Approach, Cambridge, Massachusetts, The MIT Press, pp. 464–465, 487–494, 507–510.

* cited by examiner

*Primary Examiner*—Tan Ho

(57) ABSTRACT

Multi-band antenna systems (116, 1100,1200) for wireless communication devices (100) for use in wireless communications systems (1300) are disclosed. The multi-band antennas systems include a conductive film (204, 1104, 1204) that include ground plane areas (206, 1106, 1206) and conductive traces (208, 1108, 1208) that substantially circumscribe areas that include a plurality of interconnected swaths (222–230, 1116–1120, 1216–1220). The antenna systems are capable of operating in a first common mode for supporting communications in a first frequency band, and in a second common mode and differential mode for supporting communications in a second frequency band. Nulls of gain patterns of the second common and differential mode are offset, such that sum of the gain patterns does not include nulls.

12 Claims, 14 Drawing Sheets

MULTI-BAND ANTENNAS

BACKGROUND OF THE INVENTION

1. Field of the Invention

The present invention relates in portable wireless communication devices. More particularly, the present invention relates to compact antennas for portable wireless communication devices.

2. Description of Related Art

Currently in the wireless communication industry there are a number of competing communication protocols that utilize different frequency bands. In a particular geographical region there may be more than one communication protocol in use for a given type of communication e.g., wireless telephones. In addition, certain communication protocols may be exclusive to certain regions. Additionally future communication protocols are expected to utilize different frequency bands. It may be desirable to provide 'future proof' communication devices that are capable of utilizing a currently used communication protocol, as well as communication protocols that are expected to be utilized in the near future.

It is also desirable to be able to produce wireless communication devices capable of operating according to more than one communication protocol. The latter may necessitate receiving signals in different frequency bands. It is desirable to have smaller antennas for wireless communication devices that are capable of operating a multiple frequency bands, rather than having separate antennas for different bands.

Wireless communication devices have shrunk to the point that monopole antennas sized to operate at the operating frequency of the communication device are significant in determining the overall size of the communication devices in which they are used. In the interest of user convenience in carrying portable wireless communication devices, it is desirable to reduce the size of the antenna.

BRIEF DESCRIPTION OF THE FIGURES

The present invention will be described by way of exemplary embodiments, but not limitations, illustrated in the accompanying drawings in which like references denote similar elements, and in which.

DETAILED DESCRIPTION OF THE PREFERRED EMBODIMENTS

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention.

Figure 1:
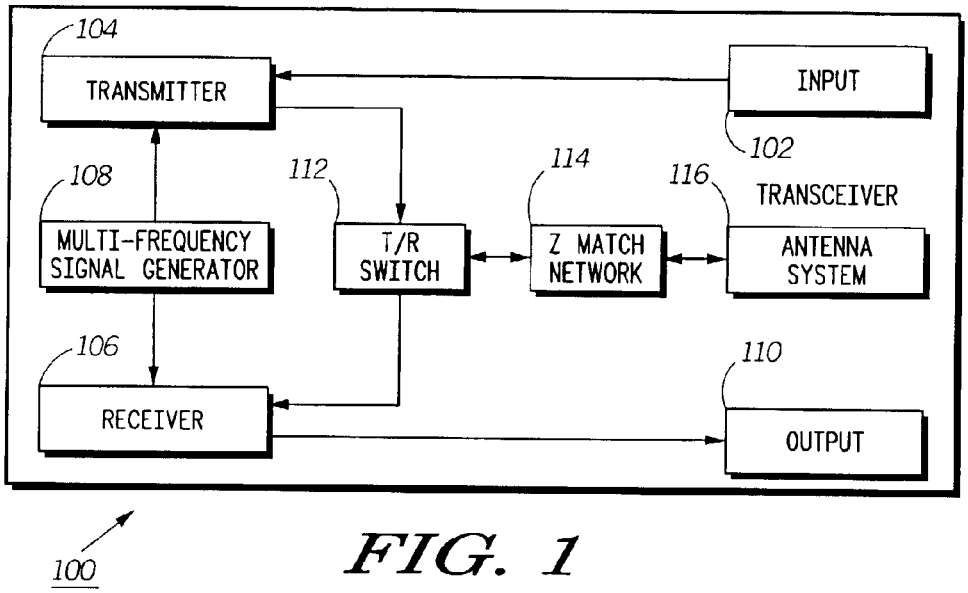
FIG. 1 is a functional block diagram of a wireless communication device according to a first embodiment of the invention.

FIG. 1 is a functional block diagram of a wireless communication device 100 according to a first embodiment of the invention. The wireless communication device 100 comprises an input 102 coupled to a transmitter circuit 104. The input 102 preferably comprises a microphone and voice encoder. Alternatively, the input 102 comprises a camera, an interface circuit, and/or other types of circuits for inputting information. The transmitter circuit 104 and a receiver circuit 106 are coupled to a multi-frequency signal generator 108. The transmitter circuit 104 and the receiver circuit 106 are communication circuits.

The multi-frequency signal generator 108 is preferably capable of producing signals in at least two frequency bands. The signals that are output by the multi-frequency signal generator 108 are modulated by the transmitter circuit 104 in order to create information bearing radio signals. The signals output by the multi-frequency signal generator 108 are also used by the receiver circuit 106 to demodulate information bearing radio signals. In certain communication systems there is an offset between a frequency used by the transmitter circuit 104 to generate a radio signal in a particular band, and a frequency used by the receiver circuit 106 to demodulate a signal in the same band.

The receiver circuit 106 is coupled to an output 110. The output 110 preferably comprises an encoded voice signal decoder, and a loud speaker. Alternatively, the output also comprises a display and display driver circuits and/or other type of information output.

The transmitter circuit 104 and the receiver circuit 106 are coupled to a transmit/receive (T/R) switch 112. Alternatively, a duplexer is used instead of the T/R switch 112. The T/R switch 112 is in turn coupled through an impedance matching circuit 114 to an antenna system 116. Alternatively, the impedance matching circuit 114 is eliminated.

Figure 2:
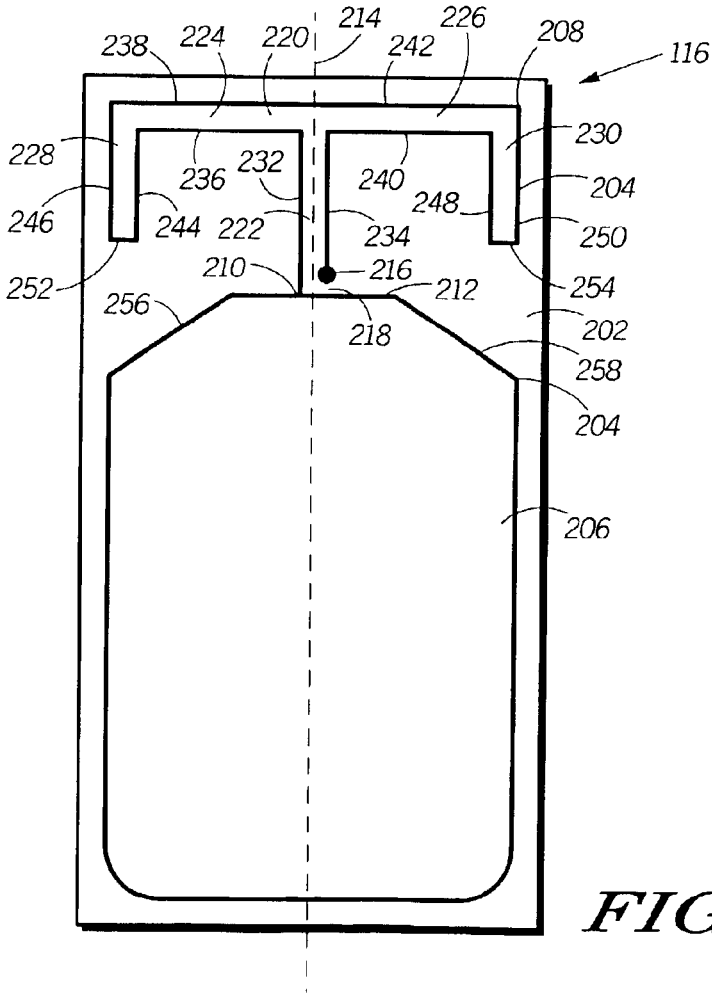
FIG. 2 is a plan view of an antenna system for the wireless communication device shown in FIG. 1 according to the first embodiment of the invention.

FIG. 2 is a plan view of the antenna system 116 of the wireless communication device 100 shown in FIG. 1 according to the first embodiment of the invention. The antenna system 116 is fabricated on a dielectric substrate 202. The antenna system 116 comprises a conductive film 204 supported on the dielectric substrate 202. The conductive film 204 comprises a ground plane area 206, and a conductive trace 208. The ground plane area 206, in addition to serving as part of the antenna system 116 preferably is also used as a ground plane for communication circuits (not shown in FIG. 2) that are part of the wireless communication device 100 (FIG. 1). The ground plane area 206 is preferably smaller in each dimension than one-half the free space wavelength of the lowest frequency mode of the antenna system 116.

The conductive trace 208 includes a first end 210 that is connected to an edge 212 of the ground plane area 206 near a longitudinal centerline 214 of the antenna system 116. The conductive trace 208 further comprises a second end 216 that is located proximate the ground plane area 206, and proximate the first end 210, but is spaced from the ground plane area 206 by a gap 218. The second end 216 and the ground plane area 206 serve as signal terminals for coupling signals to and from the antenna system 116. The multi-frequency signal generator 108 is coupled and applies signals (e.g., through the transmitter 104, T/R switch 112, and impedance matching network 114) between the ground plane area 206, and the second end 216.

The conductive trace 208 follows a path that circumscribes an area 220 that includes a plurality of connected swaths 222, 224, 226 228, 230 including a first swath 222 that extends along the longitudinal centerline 214 of the antenna system 116 from the ground plane area 206, a second swath 224 that extends to the left from an end of the first swath 222 that is remote from the ground plane area 206, a third swath 226 that extends to the right from the end of the first swath 222 that is remote from the ground plane area 206, a fourth swath 228 that extends parallel to the first swath 222 from an end of the second swath 224 that is remote from the first swath 222 down towards the ground plane area 206, and a fifth swath 230 that extends parallel to the first swath 222 from an end of the third swath 226 that is remote from the first swath 222 down towards the ground plane area 206. Note that directions recited herein are relative to one particular frame of reference, i.e., the perspective shown in the particular figure being discussed, and in use the orientation of the antenna system 116 can be changed, and in particular can be inverted. Providing the fourth 228 and fifth swaths 230 allows a long length conductive trace 208 to be accommodated on a substrate 202 of limited width, and thus allows the antenna system 116 to be packaged in a space efficient manner in the wireless communication device 100.

The area 220 includes a T-shaped portion including a stem portion that includes the first swath 222, an arm portion that includes that includes the second 224, and third 226 swaths.

The path of the conductive trace 208 includes a plurality of pairs of parallel segments 232–250, and additional segments 252, 254 that connect parallel segments at places where the conductive trace 208 reverses direction (e.g., by turning through two consecutive ninety degree turns.) The plurality of pairs of parallel segments 232–250 includes a first parallel pair of segments 232, 234 including a first segment 232 and a second segment 234 located on opposite sides of the first swath 222. The first segment 232 includes the first end 210 of the conductive trace 208, and the second segment 234 includes the second end 216 of the conductive trace 208. A second pair of segments 236, 238 including a third segment 236, and a fourth segment 238 are located on opposite sides of the second swath 224. The first segment 232 and the third segment 236 meet at a ninety-degree junction. A third pair of segments 240, 242 including a fifth segment 240, and sixth segment 242 are located on opposite sides of the third swath 226. The second segment 234 and the fifth segment 240 meet at a ninety-degree junction. The fourth segment 238 and the sixth segment 242 form a continuous linear segment. A fourth pair of segments 244, 246 including a seventh segment 244, and an eighth segment 246 are located on opposite sides of the fourth swath 228. The seventh segment 244 and the third segment 236 meet at a ninety-degree junction. The fourth segment 238 and the eighth segment 246 also meet at a ninety-degree junction. A fifth pair of segments 248, 250 including a ninth segment 248, and a tenth segment 250 are located on opposite sides of the fifth swath 230. The ninth segment 248, and the fifth segment 240 meet at a ninety-degree junction. The sixth segment 242, and the tenth segment 250 also meet at a ninety-degree junction. A first additional segment 252 extends between ends of the seventh 244 and eighth 246 segments that are remote from the second 236, and third 238 segments respectively. Similarly, the second additional segment 254 extends between ends of the ninth 248 and tenth 250 segments that are remote from the fifth 240 and sixth 242 segments respectively. The above-mentioned junctions need not be at precisely ninety degrees. Moreover rather than following a path made up of rectilinear segments, the conductive trace 208 alternatively follows a path that includes curvilinear segments.

The ground plane area 206 includes chamfered corners 256, 258 on opposite sides of the longitudinal centerline 214 facing the conductive trace 208. Providing chamfered corners serves to control the capacitance between the ground plane area 206, and portions of the conductive trace 208 in the vicinity of the additional segments 252, 254. Alternatively, no chamfering is used.

Figure 3:
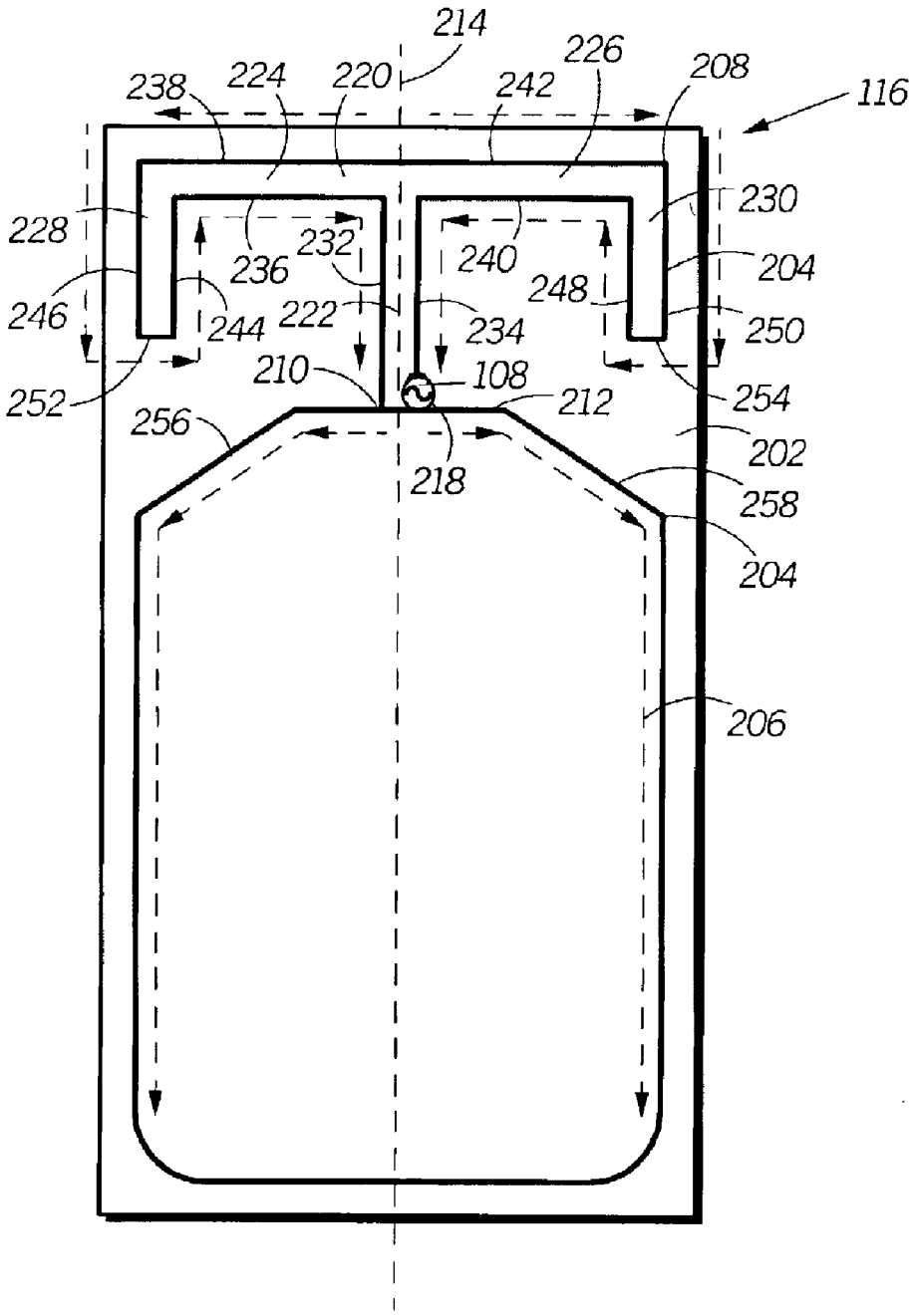
FIG. 3 is a plan view of the antenna system shown in FIG. 2, including arrows indicating current flow direction at an instant in time when the antenna system is operating in a first common mode.

FIG. 3 is a plan view of the antenna system 116 shown in FIG. 2, including arrows indicating current flow direction at an instant in time when the antenna system is operating in a first common mode. When the antenna system 116 is operating in the first common mode or in a second common mode shown in FIG. 4 current in the first 232 and second 234 segments of the conductive trace 208 flows in a common mode. In other words, the current in the first 232 and second 234 segments is in phase and flows in the same directions at any given instant. When operating in either common mode a substantial current flows in the ground plane area 206 of the conductive film 204, and the substantial current includes a substantial component that flows parallel to the longitudinal centerline 214 of the antenna. Current flowing in the ground plane area is concentrated near side periphery of the ground plane area 206. In the first common mode, at any give instant, current flows in the ground plane in a common longitudinal direction (e.g., up or down).

In FIG. 3, the multi-frequency signal generator 108 is symbolically represented between the second end 216 of the conductive trace 208, and the ground plane area 206. When operating in the common mode current flow in the antenna system is symmetric with respect to the longitudinal centerline 214. The current flow in the both common modes exhibits magnetic mirror symmetry.

According to alternative embodiments of the invention the antenna system 116 is altered so as not to be symmetric with respect to the longitudinal centerline 214, and the current flow is also not fully symmetric with respect to the centerline 214 when operating in the common mode.

Figure 4:
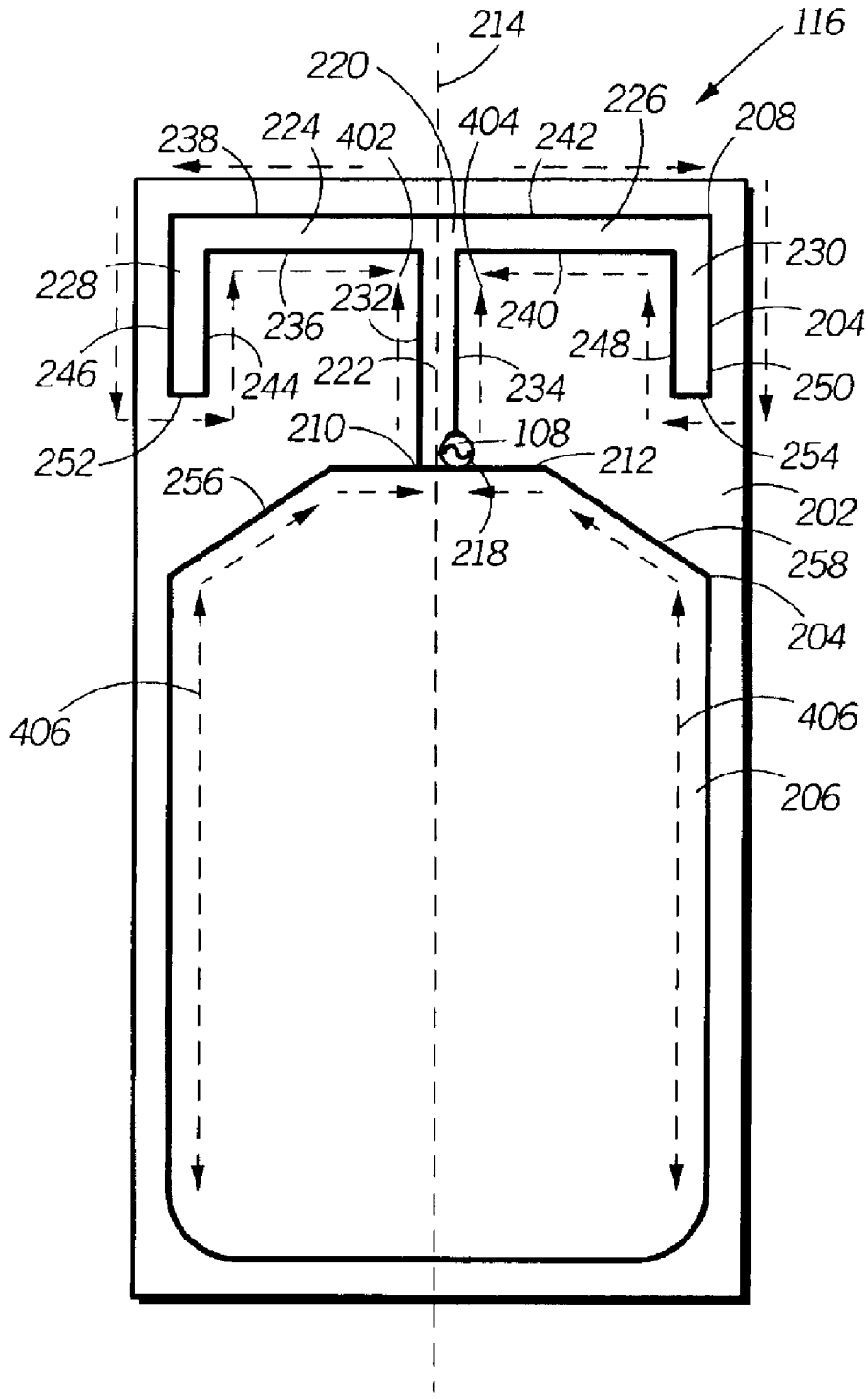
FIG. 4 is a plan view of the antenna system shown in FIG. 2, including arrows indicating current flow direction at an instant in time when the antenna system is operating in a second common mode.

FIG. 4 is a plan view of the antenna system shown in FIG. 2, including arrows indicating current flow direction at an instant in time when the antenna system is operating in a second common mode. In the second common mode, current flows in the first 232 and second 234 segments in a common mode. However, unlike the first common mode, in the second common mode, there is a first current null 402 proximate the juncture of the first segment 232 and the third segment 236, a second current null 404 proximate the junction of the second segment 234 and the fifth segment 240, and a pair of current nulls 406 at intermediate positions along the length of the ground plane area 204.

Figure 5:
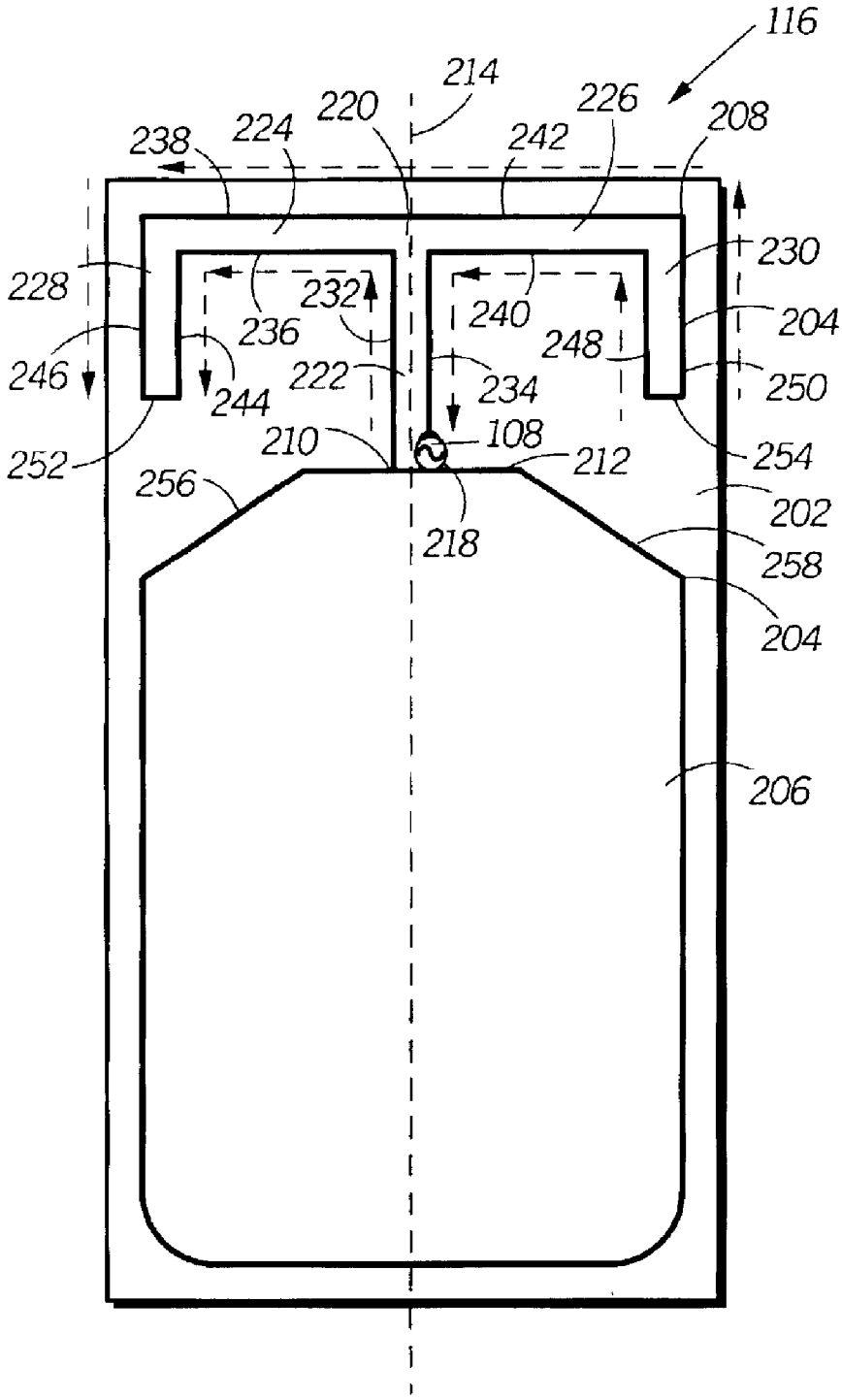
FIG. 5 is a plan view of the antenna system shown in FIG. 2, including arrows indicating current flow direction at an instant in time when the antenna system is operating in a differential mode.

FIG. 5 is a plan view of the antenna system 116 shown in FIG. 2, including arrows indicating current flow direction at an instant in time when the antenna system is operating in a differential mode. When the antenna system 116 is operating in the differential mode current flows in the first 232, and second 234 segments of the conductive trace 208 in a differential mode. In other words current flows in the first 232 and second 234 segments are opposite in phase and at any given instant (when the current flows in the two segments 232, 234 are non zero) the current flows are opposite in direction. In the differential mode, current flow in the antenna system 116 is anti-symmetric with respect to the longitudinal centerline 214 of the antenna system 116. Current flow in the differential mode exhibits electrical mirror symmetry. The common modes and the differential mode are electromagnetic resonance modes.

Figure 6:
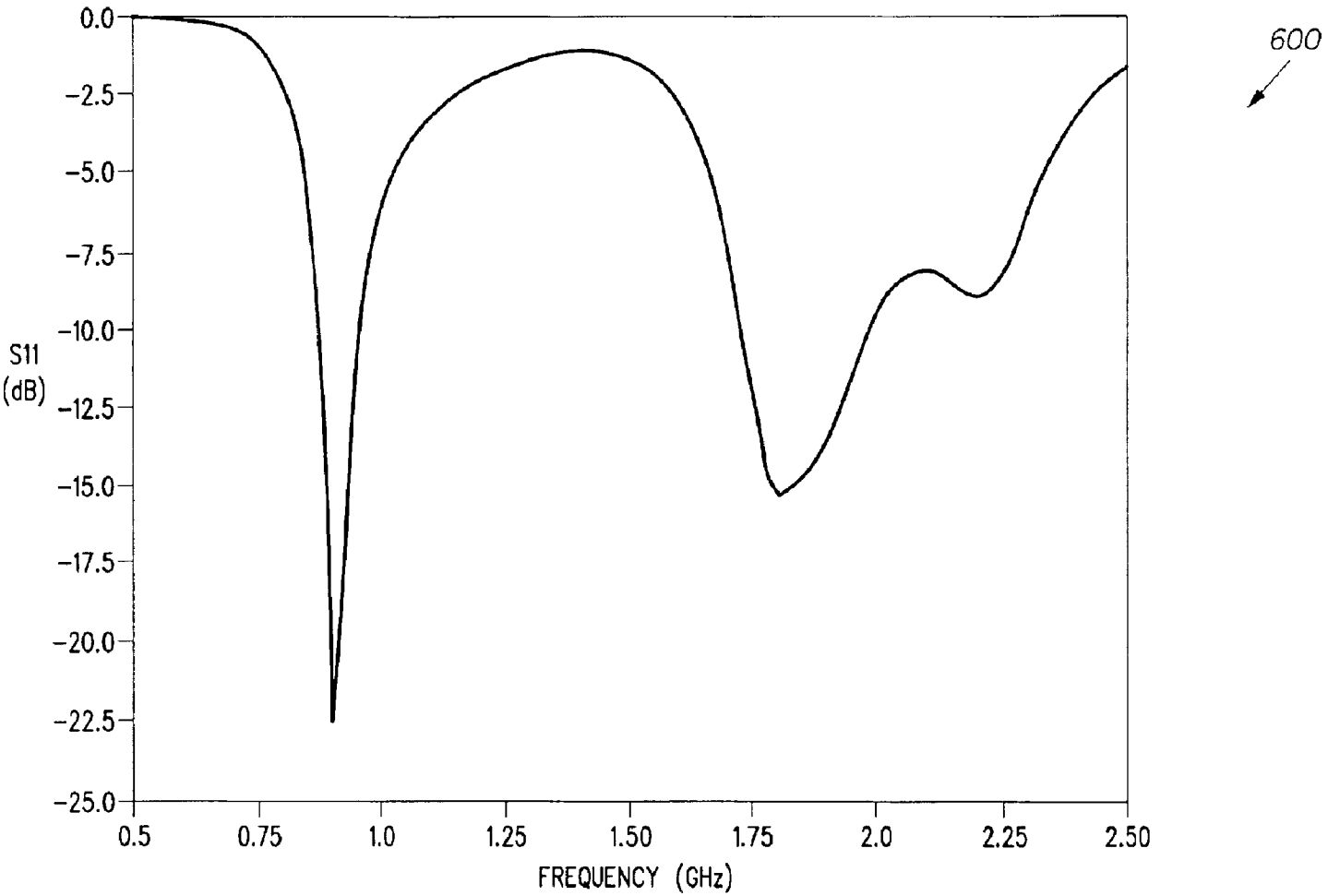
FIG. 6 is a graph including a return loss plot for the antenna system shown in FIGS. 2–5.

FIG. 6 is a graph 600 including a return loss plot 602 for the antenna system 116 shown in FIGS. 2–4. The return loss plot 602 includes a resonance at about 950 MHz that is attributable to the first common mode of the antenna system 116, a second resonance that is centered at about 1.75 GHz that is attributable to the differential mode, and a third resonance that is attributable to the second common mode centered at about 2.25 GHz. The latter two resonances combine to form a broad band of operation that extends from about 1.6 GHz to 2.4 GHz. FIG. 6 shows that the antenna system 116 supports communication in two bands including the band that extends from 1.6 to 2.4 GHz which is wide enough to support a large number of communication channels, high data rate communication, and/or more than one communication protocol. Note that power can be coupled to and from both the common and differential modes by coupling an external communication circuit between the second end 216 of the conductive trace 208 and the ground plane area 206 of the conductive film 204.

Figure 7:
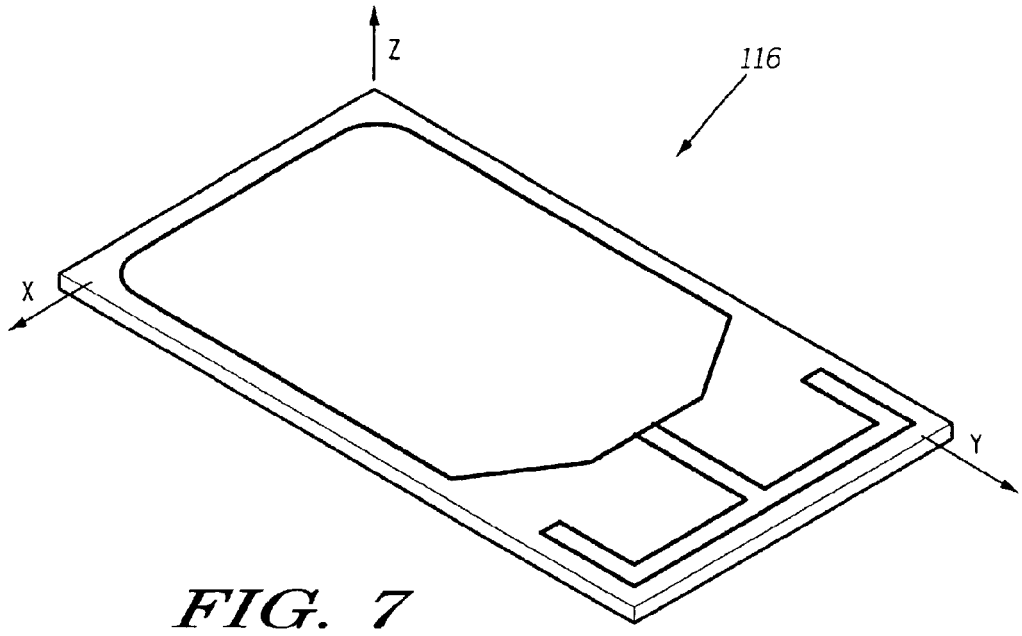
FIG. 7 is a perspective view of the antenna system shown in FIGS. 2–5 with axes of a Cartesian coordinate system shown.

FIG. 7 is a perspective view of the antenna system shown in FIGS. 2–5 with axes of a Cartesian coordinate system shown. The X, Y, and Z axes of the coordinate system are labeled in FIG. 7.

Figure 8:
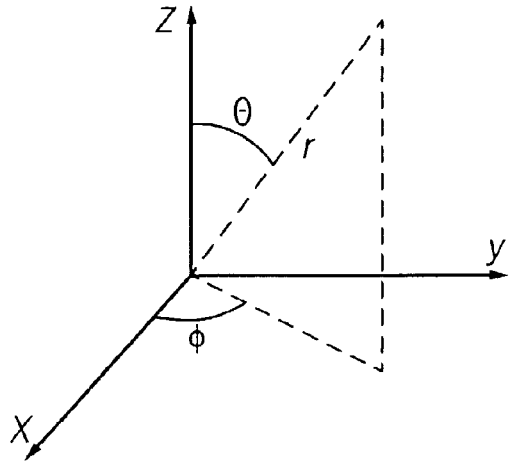
FIG. 8 is a diagram illustrating the relationship between the Cartesian coordinate system shown in FIG. 7 and a spherical coordinate system.

FIG. 8 is a diagram illustrating the relationship between the Cartesian coordinate system shown in FIG. 7 and a spherical coordinate system. The relationships between the Cartesian coordinates X, Y, Z and the polar angle theta, and azimuthal angle phi of the spherical coordinate system are shown in FIG. 8.

Figure 9:
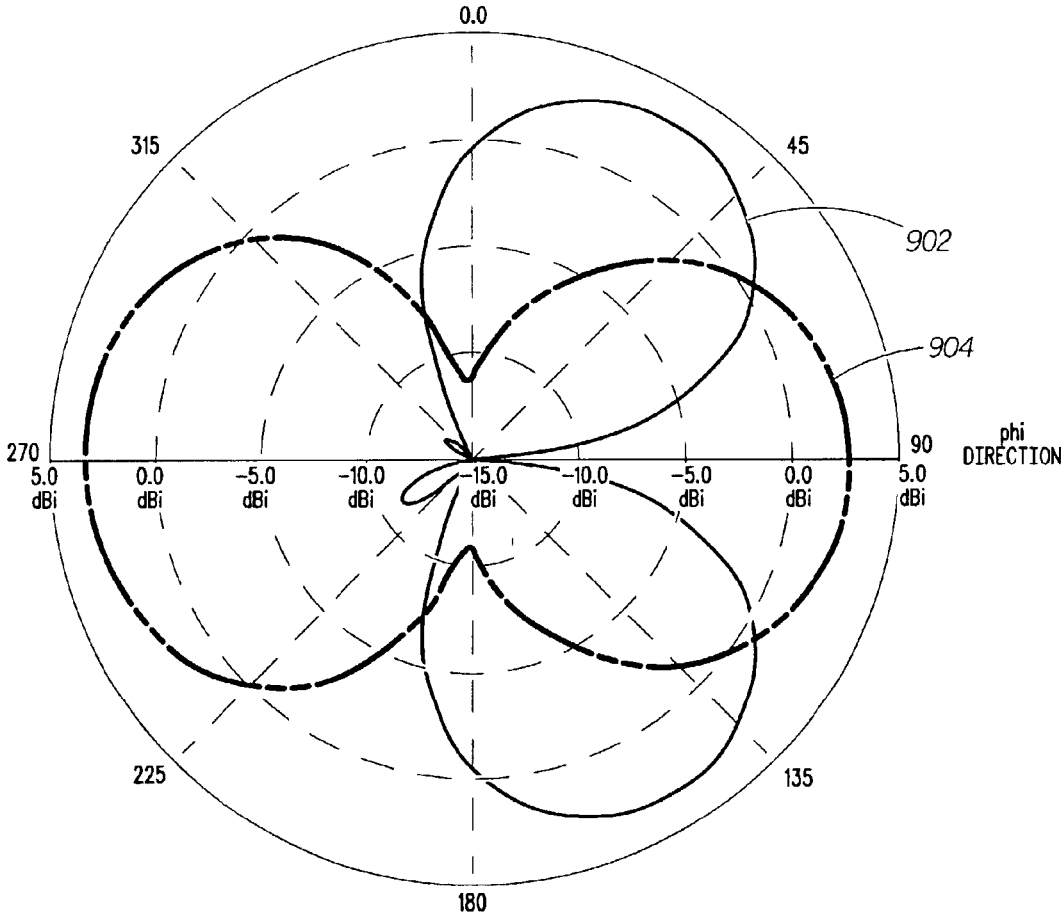
FIG. 9 is a graph including separate gain plots for the antenna system shown in FIGS. 2–5 for the second common mode addressed in FIG. 4, and for the differential mode addressed in FIG. 5.
Figure 10:
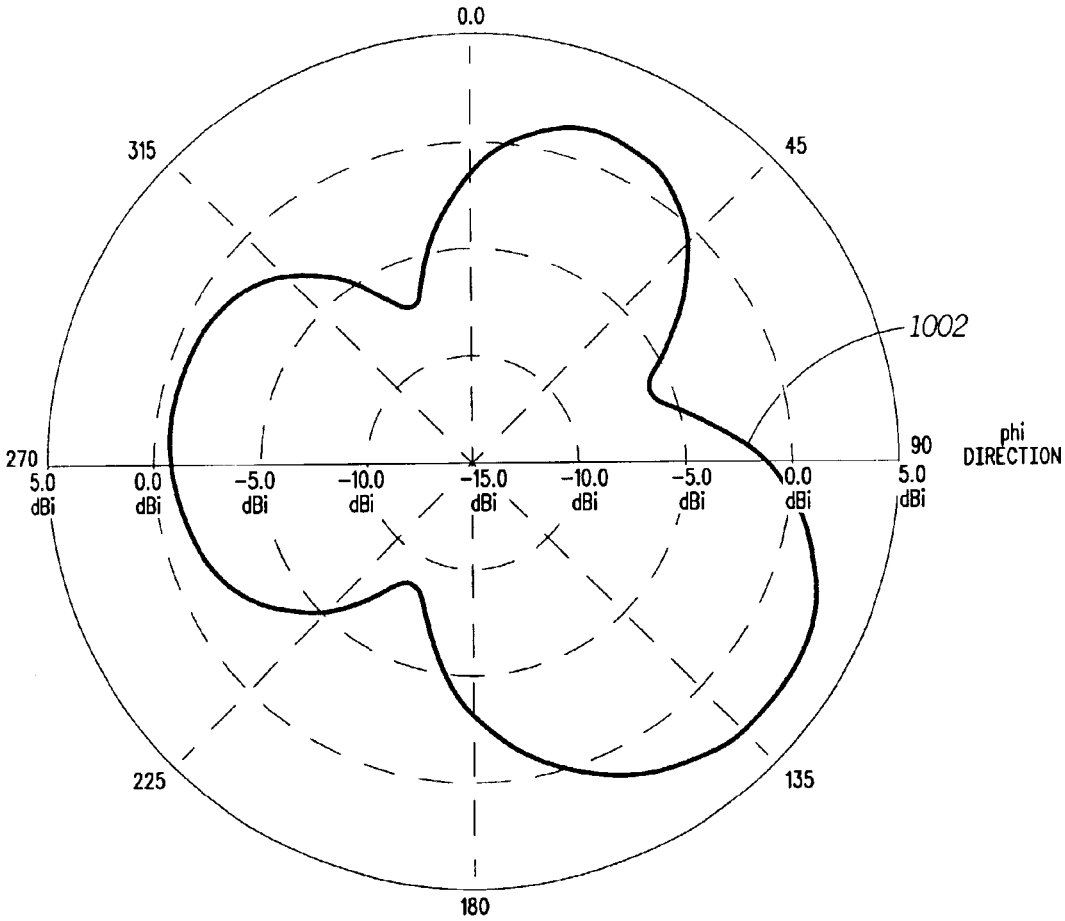
FIG. 10 is a graph including a gain plot for the antenna system shown in FIGS. 2–4 when driven in an unbalanced manner.

FIG. 9 is a graph including separate gain plots for the antenna system shown in FIGS. 2–5 for the second common mode addressed in FIG. 4, and for the differential mode addressed in FIG. 5. The plots of FIG. 9 and FIG. 10 represent data taken in the theta=90 plane (X-Y plane). A first plot 902 shows the gain for a pure second order common mode. The first plot 902 includes a first lobe oriented in the positive X-axis direction, and a second lobe oriented in the negative X-axis direction. A second plot 904 shows the gain for a pure differential mode. The second plot includes a first lobe oriented in the positive Y-axis direction, and a second lobe oriented in the negative Y-axis direction.

FIG. 10 is a graph including a gain plot 1002 for the antenna system shown in FIGS. 2–4 when driven in an unbalanced manner, i.e., when the ground plane area 206, and the first end 216 of the conductive trace 208 are used as signal terminals. Coupling signals, that have a frequency in the band associated with the second order common mode, and the differential mode, to the antenna in the an unbalanced manner excites a superposition of the second order common and the differential mode. As shown in FIG. 10 the resulting gain pattern is devoid of nulls.

Figure 11:
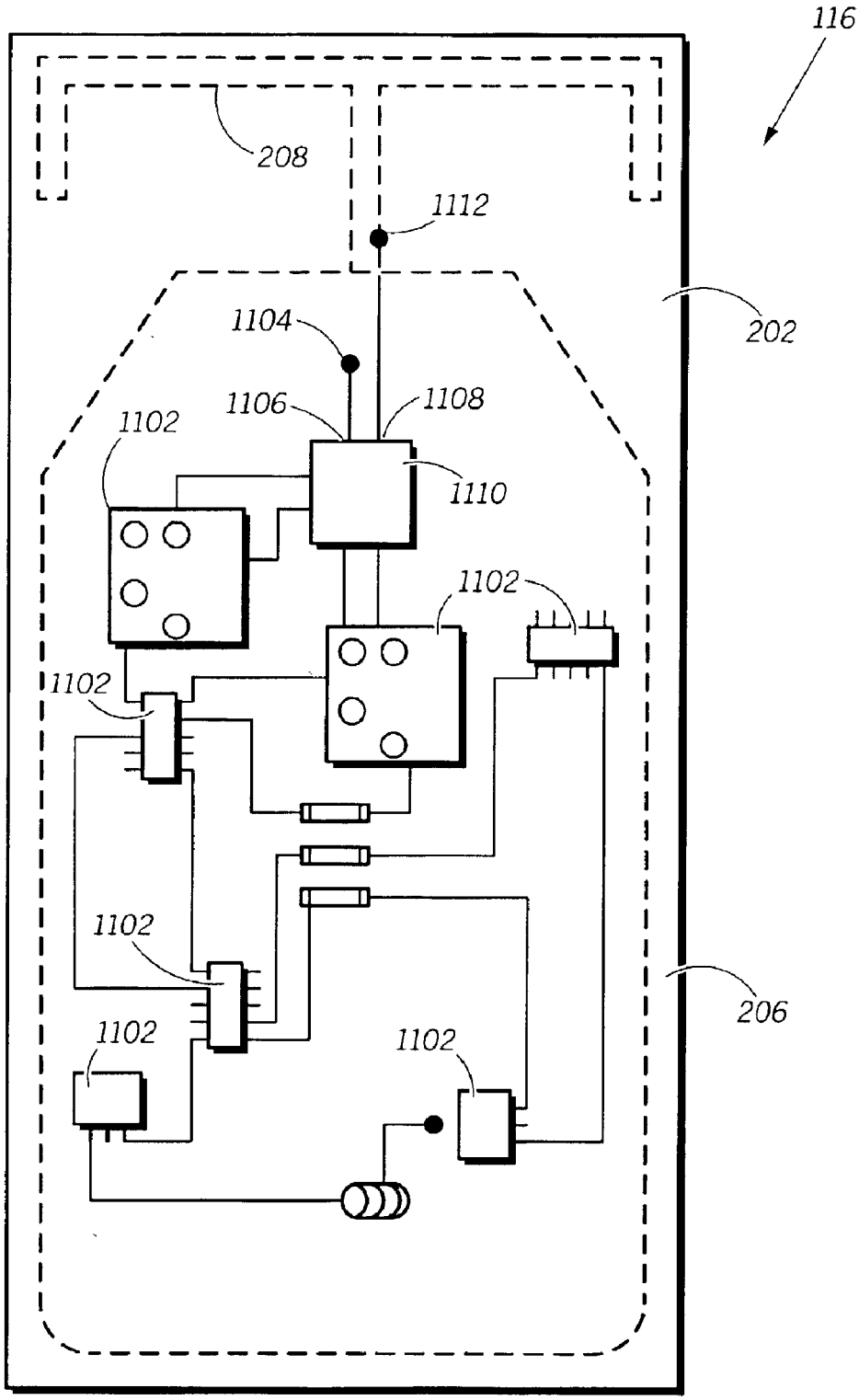
FIG. 11 is an x-ray view of the reverse side of a substrate on which the antenna system shown in FIGS. 2–5 is fabricated showing electrical circuit components of the wireless communication device shown in FIG. 1.

FIG. 11 is an x-ray view of the reverse side of the dielectric substrate 202 on which the antenna system 116 shown in FIGS. 2–4 is fabricated showing electrical circuit components 1110, 1102 of the wireless communication device shown in FIG. 1. The electrical circuit components 1102, 1110 preferably embody blocks of the electrical block diagram shown in FIG. 1, and includes an impedance matching network component 1110. A first via 1004 that passes through the dielectric substrate 202 is used to couple a first 1106 of a pair of antenna coupling terminals of the impedance matching network component 1110 to the ground plane area 206 of the conductive film 204. A second via 1112 is used to couple the second 1108 of the pair of antenna coupling terminals of the impedance matching network component 1110 to the second end 216 of the conductive trace 208 of the conductive film 204. The same dielectric substrate 202 on which the antenna system 116 is fabricated, is preferably also used as a circuit substrate for supporting and interconnecting circuit components 1102, 1110 of communication circuits of the wireless communication device 100. Thus, the antenna system 116 lends itself to being incorporated in a portable wireless communication device in a space efficient manner. The wireless communication device 100 is preferably portable. Alternatively, the ground plane area 206 comprises a plurality connected metallized layers of a multi-layer circuit board.

Figure 12:
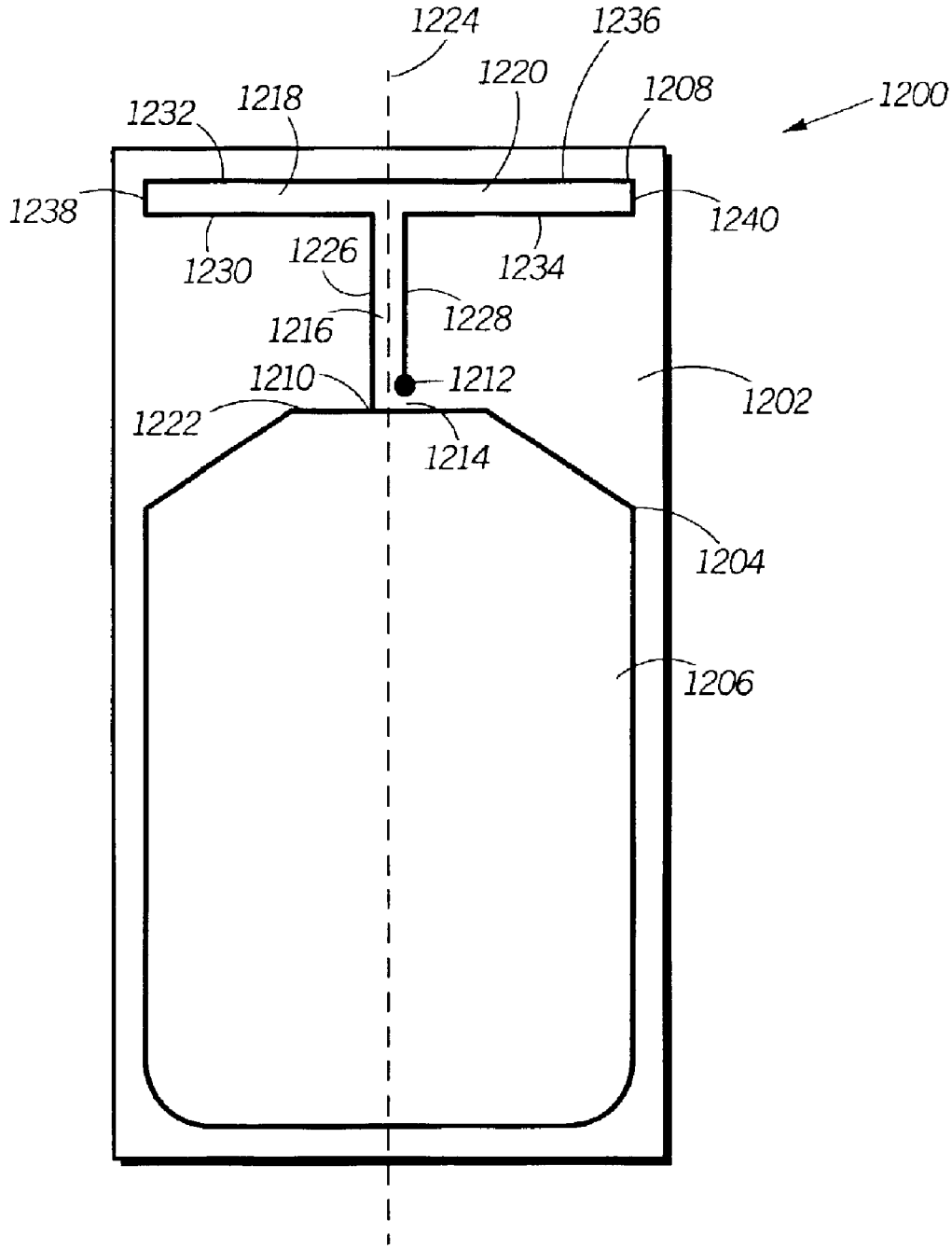
FIG. 12 is a plan view of an antenna system according to a second embodiment of the invention.

FIG. 12 is a plan view of an antenna system 1200 according to a second embodiment of the invention. The second alternative antenna system 1200 is also fabricated on a dielectric substrate 1202. The second alternative antenna system 1200 also comprises a conductive film 1204 that includes a ground plane area 1206, and a conductive trace 1208. The conductive trace 1208 includes a first end 1210 that is connected to the ground plane area 1206, and a second end 1212 that is located near the first end 1210, and near the ground plane area 1206, and is separated from the ground plane area 1206 by a small gap 1214. Communication circuits (not shown in FIG. 12) are connected between the ground plane area 1206, and the second end 1212 of the conductive trace 1208. The conductive trace 1208 follows a path that substantially (except for the small gap 1214) circumscribes an area that comprises a plurality of interconnected swaths 1216, 1218, 1220, including a first swath 1216 that extends from an edge 1222 of the ground plane area 1206 along a longitudinal centerline 1224 of the antenna system 1200, a second swath 1218 that extends to the left from an end of the first swath 1216 remote from the ground plane area 1206, and a third swath 1220 that extends to the right from the end of the first swath 1216 that is remote from the ground plane area 1206. The three swaths 1216, 1218, 1220 form a T-shaped area, with the first swath 1216 forming the stem of the T-shaped area, and the second 1218, and third swaths 1220 forming the arm of the T-shaped area.

The conductive trace 1208 comprises a plurality of pairs of parallel segments 1226–1236, and additional segments 1238, 1240 that interconnect parallel segments where the path of the conductive trace 1208 reverses direction (e.g., by turning through two consecutive ninety degree turns). A first pair of parallel segments 1226, 1228 includes a first segment 1226, and a second segment 1228 that are disposed on opposite sides of the first swath 1216. The first segment 1226 includes the first end 1210 of the conductive trace 1208, and the second segment 1228 includes the second end 1212 of the conductive trace 1208. A second pair a parallel segments 1230, 1232 includes a third segment 1230, and a fourth segment 1232 that are disposed on opposite sides of the second swath 1218. The third segment 1230 connects to the first segment 1226 at a ninety degree junction. A third pair of segments 1234, 1236 includes a fifth segment 1234 and a sixth segment 1236 that are disposed on opposite sides of the third swath 1220. The fifth segment 1234, connects to the second segment 1228 at a ninety degree junction. The forth segment 1232 is co-linear with the sixth segment 1236. A first additional segment 1238 connects ends of the third 1230 and fourth segments 1232 that are remote from the first swath 1216. A second additional segment 1240 connects ends of the fifth 1234, and sixth 1236 segments that are remote from the first swath 1216.

The second alternative antenna system 1200 supports a first common mode, a second common mode, and a differential mode analogous to the common and differential modes discussed with reference to FIGS. 3–5. In the common modes of the second alternative antenna system 1200, current flows on the first 1226, and second 1228 segments of the conductive trace 1208 in common mode. In the differential mode of the second alternative antenna system 1200 current flows in the first 1226 and second 1228 segments in differential mode.

Figure 13:
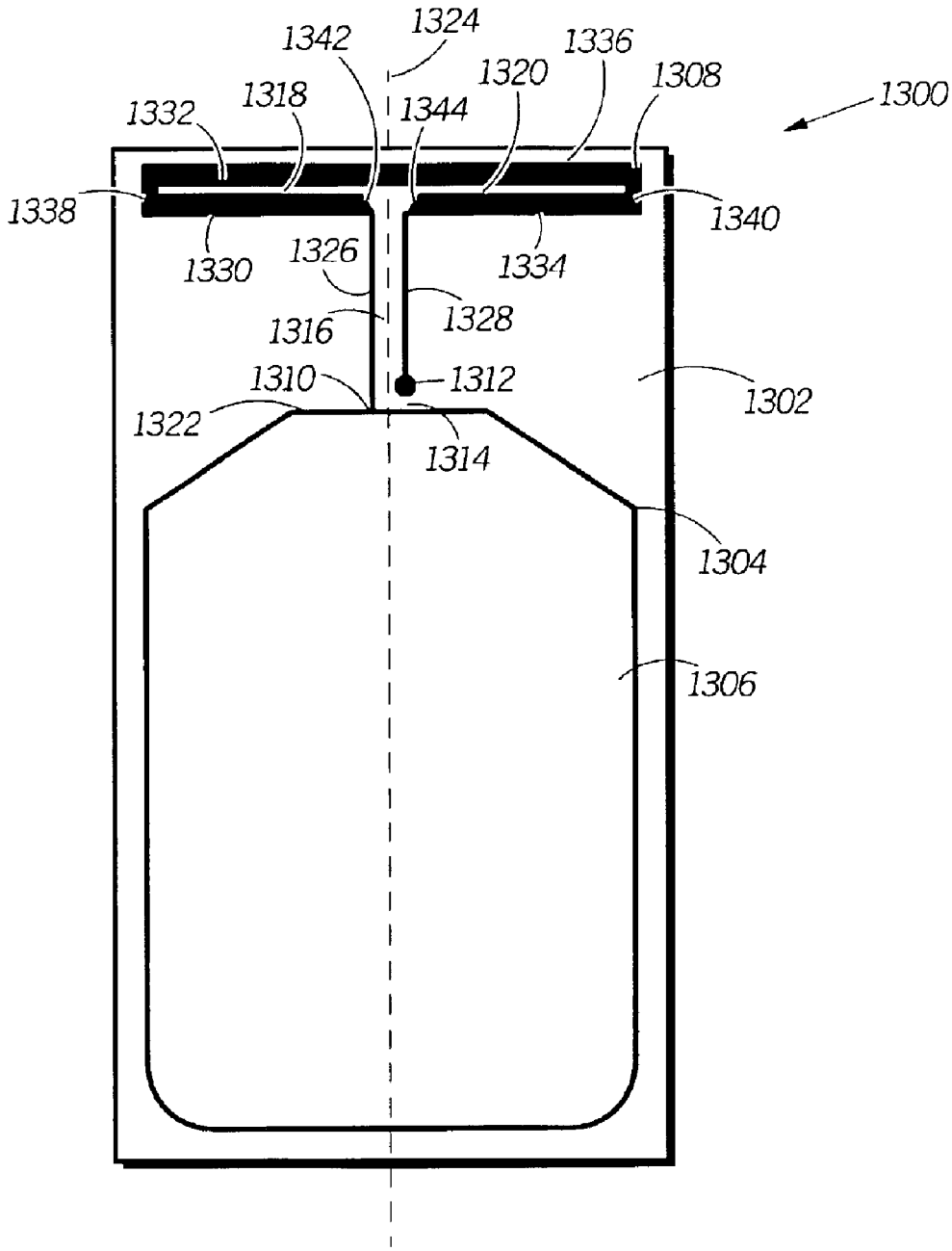
FIG. 13 is a plan view of an antenna system according to a third embodiment of the invention.

FIG. 13 is a plan view of an antenna system 1300 according to a third embodiment of the invention. Reference numerals in FIGS. 12, 13 that have the same last two digits refer to like parts. The third embodiment antenna system 1300, is a modification of the second embodiment antenna system 1200 in which third through sixth segments 1330, 1332, 1334, 1336 of the conductive trace 1308 have a greater width compared to first 1326 and second 1328 segments of the conductive trace 1328. A first tapered section 1342 connects the first segment 1326 and the third segment 1330, and a second tapered section 1344 connects the second segment 1328 and the fifth segment 1334. The width of the first 1326 and second 1328 segments provides for improved impedance matching. Impedance matching is improved by designing the characteristic impedance of the transmission line formed by the first 1326 and second 1328 segments to be twice the impedance seen by the antenna system at the port defined by the gap 1314. The latter consideration applies to other embodiments described herein.

Figure 14:
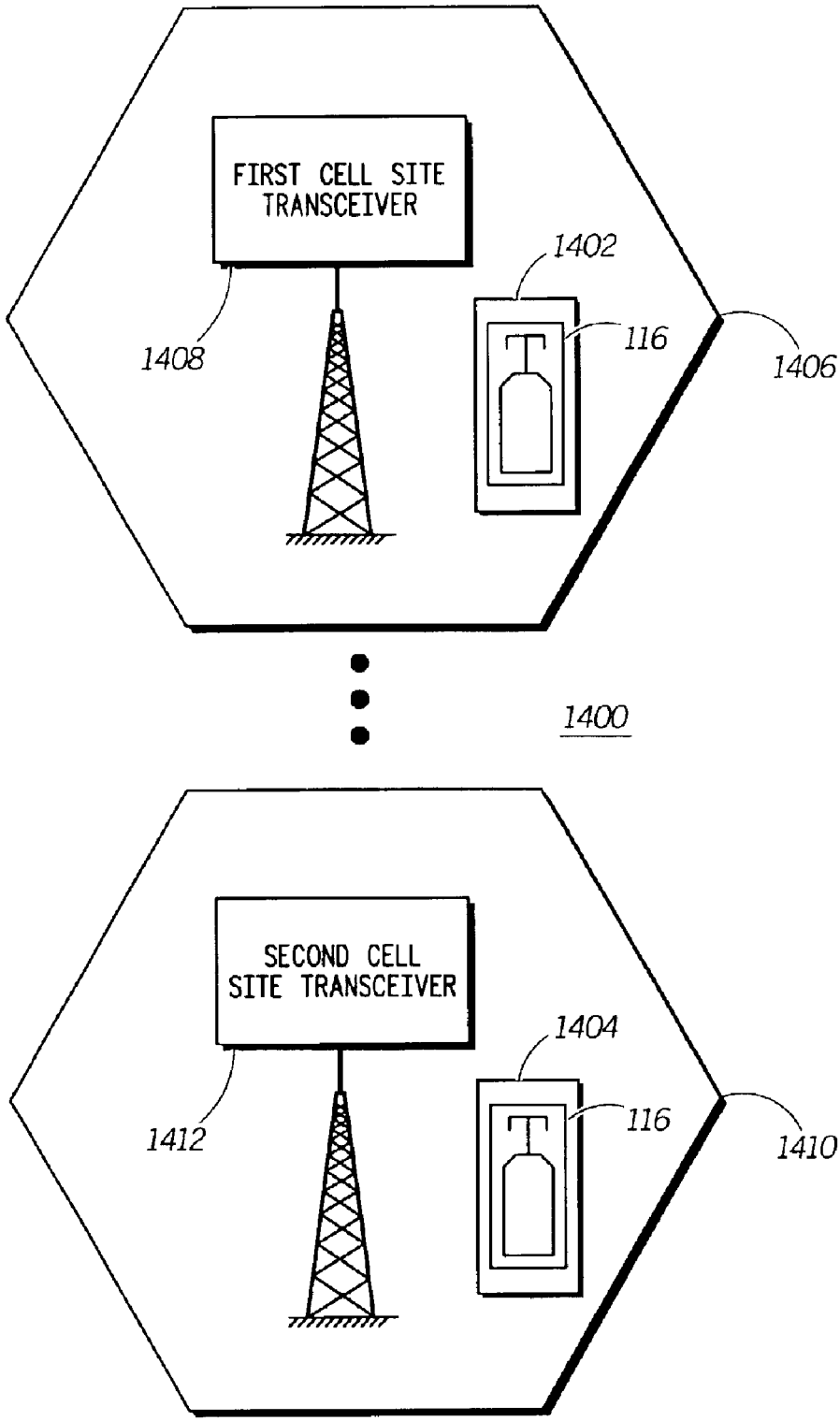
FIG. 14 is a schematic diagram of a cellular communication system that includes wireless communication devices of the type shown in FIG. 1 including the antenna system shown in FIGS. 2–4.

FIG. 14 is a schematic diagram of a cellular communication system 1400 that includes wireless communication devices 1402, 1404 of the type shown in FIG. 1 including the antenna system 116 shown in FIGS. 2–4. A first cell 1406 of the communication system 1400 includes a first cell site transceiver 1408. The first cell, site transceiver 1408 for example supports communication in a frequency band corresponding to the first common mode of the antenna system 116. A second cell 1410 of the communication system 1400 includes a second cell site transceiver 1412 that supports communication in a second band corresponding to the second common mode and the differential mode of the antenna system. A first wireless communication device 1402 is shown in the first cell 1406, and a second wireless communication device 1404 is shown in the second cell 1410, however it is to be understood that wireless devices of the type shown in FIG. 1 including the antenna system 116 are able to roam between the two cells 1406, 1410 because the antenna system 116 supports communication in plural frequency bands. Because of the offset between nulls of the gain patterns associated with the second common mode, and differential mode as discussed with reference to FIGS. 9–10, communication with the second cell site transceiver 1412 is more reliable.

Figure 15:
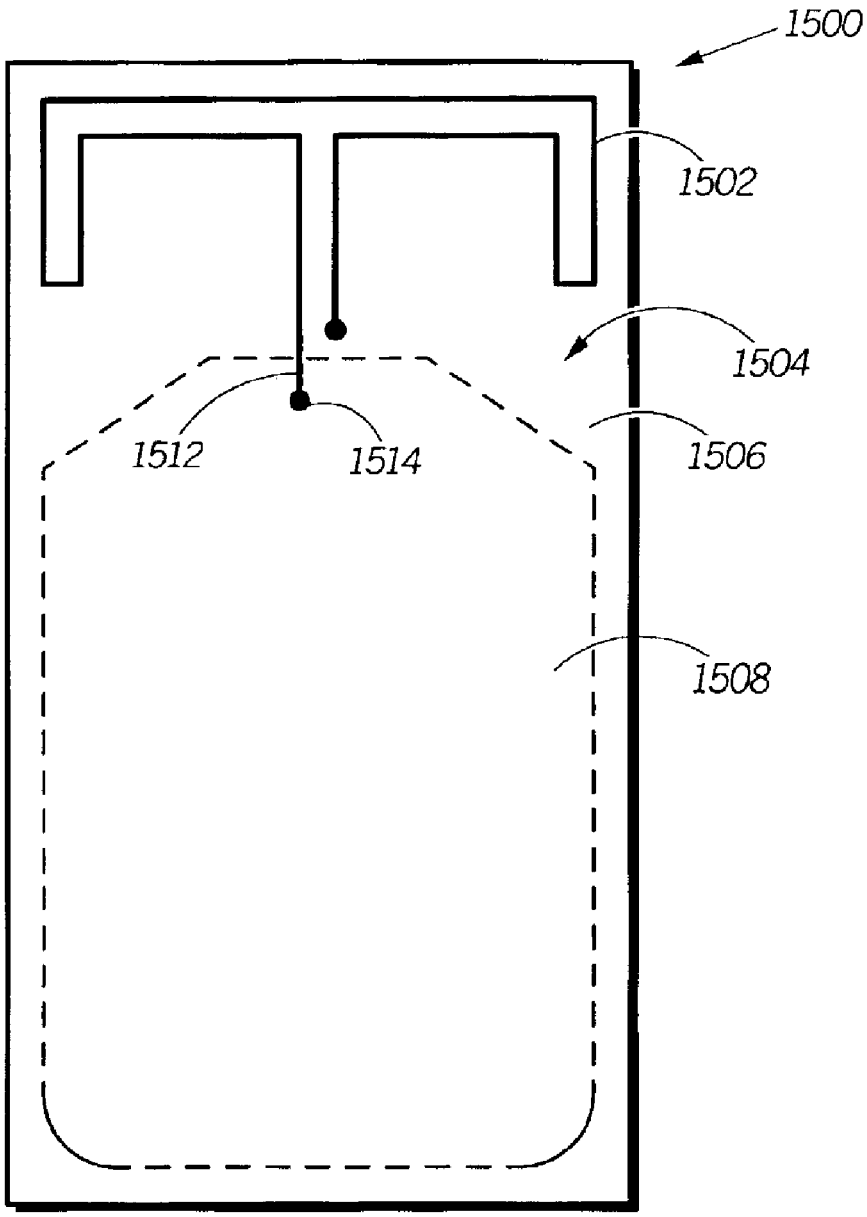
FIG. 15 is an x-ray plan view of an antenna system according to a fourth embodiment of the invention.
Figure 16:
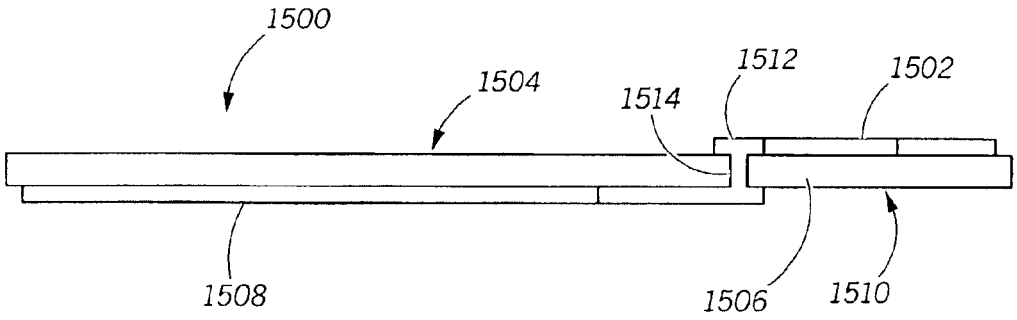
FIG. 16 is an x-ray side view of the antenna system shown in FIG. 15.

FIG. 15 is an x-ray plan view of an antenna system 1500 according to a fourth embodiment of the invention and FIG. 16 is an x-ray side view of the antenna system 1500 shown in FIG. 15. The antenna system 1500 comprises a conductive trace 1502 supported on a first side 1504 of an insulating substrate 1506. The conductive trace 1502 follows the same path as the conductive trace 208 of the first embodiment antennas system 116 described above. A ground plane area 1508 is supported on a second side 1510 of the insulating substrate 1506. The plan view shape and position of the ground plane area 1508 relative to the conductive trace 1502 is the same as in the first embodiment. A first end 1512 of the conductive trace 1502 is coupled to the ground plane area 1508 by a conductive plug 1514 that passes through a via in the insulating substrate 1506. Except for in the vicinity of the first end 1512, the conductive trace 1502 does not overlie the ground plane area 1508. Other insulating layers and electrical interconnect layers can be added to support and interconnect electrical components that form communication circuits of a portable wireless communication device, of which the antenna system 1500 is preferably a part.

Figure 17:
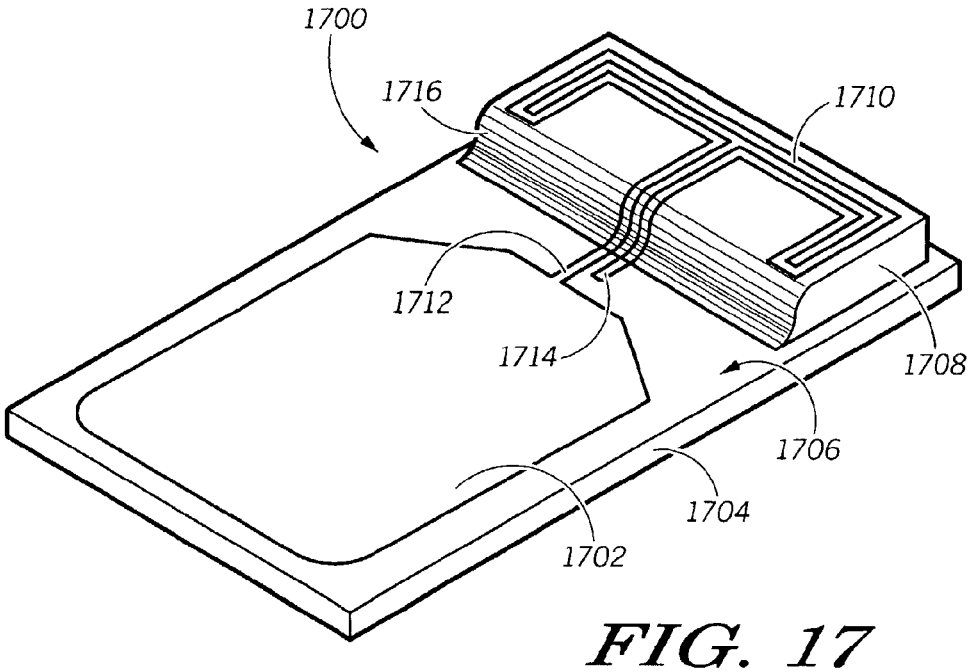
FIG. 17 is a perspective view of an antenna system according to a fifth embodiment of the invention.

FIG. 17 is a perspective view of an antenna system 1700 according to a fifth embodiment of the invention. The antenna system 1700 comprises a conductive ground plane area 1702, supported on a surface 1706 of a dielectric substrate 1704. A dielectric spacer 1708 is also supported on the surface 1706 of the dielectric substrate 1704. The dielectric spacer 1708 in turn supports a substantial portion of a conductive trace 1710 that follows a path that in plan view is the same as the conductive trace 208 of the first embodiment. A first end 1712 of the conductive trace 1710 is coupled to the ground plane area 1702, and a second end 1714 is located proximate the first end 1712 and proximate the ground plane area 1702. A communication circuit (not shown) is suitably coupled between the second end 1714 and the ground plane area 1702 for coupling signals into and out of the antenna system 1700. The conductive trace 1710 and the ground plane area 1702 can be formed on adhesive backed mylar which is adhesively affixed to the dielectric substrate 1704, and the dielectric spacer 1708. Note that the conductive trace 1710 does not overlie the ground plane 1702. The latter arrangement promotes unimpeded operation of the antenna system 1700. The dielectric spacer 1708 includes a tapered surface 1716 that tapers down toward the ground plane area 1702. The conductive trace 1702 runs over the tapered surface 1716.

Although in the embodiments described above, the overall width of the conductive traces is equal to the width of the ground plane are, alternatively, the widths differ.

While the preferred and other embodiments of the invention have been illustrated and described, it will be clear that the invention is not so limited. Numerous modifications, changes, variations, substitutions, and equivalents will occur to those of ordinary skill in the art without departing from the spirit and scope of the present invention as defined by the following claims.

What is claimed is:

1. An antenna system comprising:

a conductive film including:

a ground plane area; and a conductive trace including a first end and a second end, wherein the first end is connected to the ground plane area, and the conductive trace follows a path that substantially circumscribes an area comprising one or more interconnected swaths, and wherein the second end is separated from the ground plane area by a gap, the path including parallel segments, and additional segments interconnecting the parallel segments, wherein the second end in combination with the ground plane area serve as signal terminals.

2. The antenna system according to claim 1 further comprising:

a dielectric substrate supporting the conductive film.

3. The antenna system according to claim 1 wherein:

the area comprises a first swath that extends from the ground plane area;

a second swath that is connected to the first swath and extends in a first direction relative to the first swath; and a third swath that is connected to the first swath and extends in a second direction relative to the first swath.

4. The antenna system according to claim 3 wherein:

the area includes a T shaped portion including a stem portion and an arm portion and the bottom of the stem portion is adjacent the ground plane area.

5. The antenna system according to claim 4 wherein the area further comprises:

two additional swaths that depend from opposite ends of the arm portion of the T-shaped portion.

6. The antenna system according to claim 5 wherein the ground plane area includes chamfered corners on a side of the ground plane area facing the conductive trace.

7. The antenna system according to claim 5 wherein the conductive trace includes parallel segments on opposite sides of the arm portion of the T-shaped area; and parallel segments on opposite sides of the stem portion; and wherein the parallel segments on opposite sides of the arm portion are wider that the parallel segments on opposite sides of the stem portion.

8. An antenna system comprising:

a substrate;

a ground plane area supported by the substrate;

a conductive trace located proximate the ground plane area, displaced from the ground plane area and substantially not overlying the ground plane area, wherein the conductive trace follows a path that circumscribes an area comprising a plurality of swaths, and the conductive trace includes a first end that is coupled to the ground plane area, and a second end that is disposed proximate the ground plane area.

9. The antenna system according to claim 8 wherein:

the substrate comprises a first side and a second side;

the ground plane area is supported on the first side of the substrate; and the conductive trace is located on the second side of the substrate.

10. The antenna system according to claim 8 further wherein:

the substrate comprises a first side;

the antenna system further comprises a dielectric spacer supported on the first side of the substrate;

wherein the ground plane is supported on the first side of the substrate; and the conductive trace is at least partially supported on the dielectric spacer.

11. The antenna system according to claim 8 wherein the area comprises:

a first swath that includes a first swath first end positioned proximate the ground plane, and a first swath second end;

a second swath that extends from proximate the first swath second end in a first direction; and a third swath that extends from proximate the first swath second end in a second direction.

12. The antenna system according to claim 11 wherein:

the second swath comprises a second swath first end positioned proximate the first swath, and a second swath second end;

the third swath comprises a third swath first end positioned proximate the first swath and a third swath second end; and the area further comprises:

a fourth swath extending from proximate the second end of the second swath, substantially parallel to the first swath, toward the ground plane; and a fifth swath extending from proximate the second end of the third swath, substantially parallel to the first swath toward the ground plane area.

* * * * *